United States Patent [19]

Nagai et al.

[11] Patent Number: 4,906,035

[45] Date of Patent: Mar. 6, 1990

[54] AUTOMATIC LOCKING DEVICE FOR TRUNK LID OF MOTOR VEHICLE

[75] Inventors: Masaaki Nagai; Yutaka Yokoyama, both of Tokyo, Japan

[73] Assignee: Fuji Jukogyo Kabushiki Kaisha, Tokyo, Japan

[21] Appl. No.: 277,191

[22] Filed: Nov. 29, 1988

[30] Foreign Application Priority Data

Dec. 2, 1987 [JP] Japan ..... 62-184044[U]

[51] Int. Cl.[4] ..... E05C 3/06

[52] U.S. Cl. ..... 292/201; 292/216; 292/341.16; 292/DIG. 43

[58] Field of Search ..... 292/341.16, 201, DIG. 43, 292/196, 221, 223, 216, DIG. 25, 227

[56] References Cited

U.S. PATENT DOCUMENTS

| | | | |
|---|---|---|---|
| 2,815,085 | 12/1957 | Whipple | 292/196 |
| 2,896,990 | 7/1959 | Garvey et al. | 292/341.16 |
| 2,994,550 | 8/1961 | White | 292/341.16 |
| 3,113,447 | 12/1963 | Oishei | 292/201 |
| 3,321,226 | 5/1967 | De Claire et al. | 292/201 |
| 3,332,713 | 7/1967 | De Claire et al. | 292/201 |
| 3,347,584 | 10/1967 | Johnstone | 292/198 |
| 3,580,623 | 5/1971 | Peters | 292/201 |
| 3,835,678 | 9/1974 | Meyer et al. | 292/341.16 |
| 4,007,955 | 2/1977 | Kobayashi | 292/DIG. 43 |
| 4,202,573 | 5/1980 | Berkowitz | 292/223 |
| 4,280,725 | 7/1981 | Berkowitz et al. | 292/223 |
| 4,322,959 | 4/1982 | Mochida | 292/DIG. 43 |
| 4,395,064 | 7/1983 | Bellot et al. | 292/201 |
| 4,536,021 | 8/1985 | Mochida | 292/201 |
| 4,652,027 | 3/1987 | Quantz | 292/201 |
| 4,671,548 | 6/1987 | Häberle et al. | 292/DIG. 43 |
| 4,707,007 | 11/1987 | Inoh | 292/341.16 |
| 4,746,153 | 5/1988 | Compeau et al. | 292/229 |
| 4,763,936 | 8/1988 | Rogakos et al. | 292/201 |
| 4,796,932 | 1/1989 | Tame | 292/341.16 |
| 4,815,775 | 3/1989 | Mertin et al. | 292/201 |

FOREIGN PATENT DOCUMENTS

| | | | |
|---|---|---|---|
| 56-121068 | 8/1981 | Japan | 292/341.16 |
| 60-191652 | 12/1985 | Japan . | |

*Primary Examiner*—Gary L. Smith
*Assistant Examiner*—Eric K. Nicholson
*Attorney, Agent, or Firm*—Beveridge, DeGrandi & Weilacher

[57] ABSTRACT

A trunk lid of a motor vehicle is closed by engagement of a striker secured to the trunk lid with a latch body of a locking mechanism secured to the trunk of the vehicle. When the trunk lid is closed, the lowering thereof to its closed position is electrically detected by a trunk lid sensor and, in response to it an electrical driving device including an electric motor, is operated to rotate a claw pivotably secured to the latch body so as to move the striker in a guide slot of the claw to a locking position of the latch body. The operation of the electric motor is transmitted to the claw to rotate the same through wire means, link mechanism or gear arrangement.

4 Claims, 3 Drawing Sheets

AUTOMATIC LOCKING DEVICE FOR TRUNK LID OF MOTOR VEHICLE

BACKGROUND OF THE INVENTION

This invention relates to an automatic locking device for a trunk lid of a motor vehicle, provided with an electric means for locking the trunk lid.

A trunk lid of a motor vehicle is provided with a locking mechanism for the lid, in which a striker fixedly secured to the inside of the lid is engaged, as it advances, with a slot formed in a claw member pivoted to a latch body secured to the motor vehicle body. The striker engaged with the slot then rotates the claw member to a predetermined locking position in a guide slot of the latch body.

Various types of the trunk lid locking mechanism of this kind have been proposed. A typical one is disclosed in Japanese Utility Model Laid-Open Patent Publication (Kokai) No. Sho-60-191652 published Dec. 19, 1985.

With the trunk lid locking mechanism for motor vehicles of the character described above, when the trunk lid is closed, it is required for the user to apply a considerably large force against the repulsive force of a weather strip positioned at the peripheral edge of the opening of the trunk or against the force of a spring accommodated in the locking mechanism.

SUMMARY OF THE INVENTION

An object of this invention is to eliminate the defect or drawback of the conventional technique described above and to provide an automatic locking device for a trunk lid of a motor vehicle, provided with an electric device which enables easy and stable locking of the trunk lid without necessitating intentional depressing operation of the same and which can prevent an accidental opening of the trunk lid while the motor vehicle is moving.

This and other objects can be achieved according to this invention by providing an automatic locking device for a trunk lid of a motor vehicle, comprising a locking mechanism including a latch body secured to a rear edge of a motor vehicle trunk and provided with a guide slot to be engaged with a striker secured to an inner rear edge of the trunk lid, and a claw pivotally secured to the latch body and provided with a guide slot to guide the striker to a locking position in the guide slot of the latch body, the locking device further comprising a trunk lid sensor mounted on the trunk near the locking mechanism for detecting the lowering of the trunk lid to the vicinity of its closed position, and an electric driving device including an electric motor connected to said claw through motion transmitting means in such a manner that when the motor is energized, the claw is rotated to move the striker to said locking position, said electric motor being in such an operative association with said sensor that when the sensor detects the trunk lid at its closed position, the motor is energized to rotate the claw.

In a preferred embodiment of the invention, the motion transmitting means comprises wire means, link mechanism, a combination thereof, or gear arrangement.

According to the automatic trunk lid locking device described above, when the trunk lid is closed, the lowering of the trunk lid is detected by the sensor and the electric driving device is operated in response to an output signal of the sensor to rotate the claw of the locking mechanism through the motion transmitting means. The closing of the trunk lid is performed automatically by utilizing the electric driving device, so that manual force to close the trunk lid can be substantially eliminated and accidental release of the locking device while the motor vehicle is moving can be prevented.

Preferred embodiments of this invention will be described below in detail, with reference to the accompanying drawings.

DESCRIPTION OF THE PREFERRED EMBODIMENTS

Figure 1:
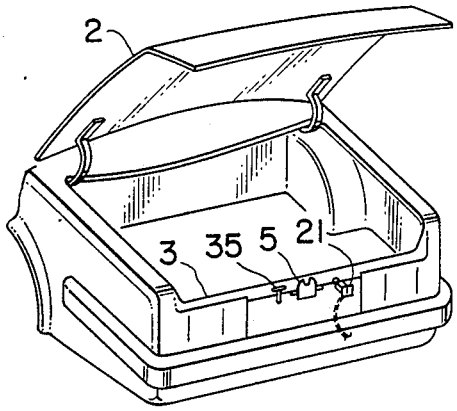
FIG. 1 is an illustration of a trunk lid of a motor vehicle in an opened state.

FIG. 1 is a fragmental illustration of the rear side of a motor vehicle, in which a trunk lid 2 for closing an opening 3 of the interior space of a trunk in the body of the vehicle is in an opened state. A locking mechanism 5 to be engaged with a striker 6 (FIG. 3) secured to the inner rear edge of the trunk lid 2 is mounted on the rear edge of the trunk opening 3. A key cylinder member 21 used for opening the trunk lid 2 is secured near the locking mechanism 5 and a switching unit or sensor 35 for detecting the lowering of the trunk lid 2 to its closing position is also mounted near the locking mechanism 5. An electric drive means for automatically locking the trunk lid 2 in the closed state is further disposed on the rear edge of the trunk opening 3, though not illustrated in FIG. 1.

The constructions and operations of the striker and the locking mechanism 5 will be described below with reference to FIGS. 3 and 4.

Figure 3:
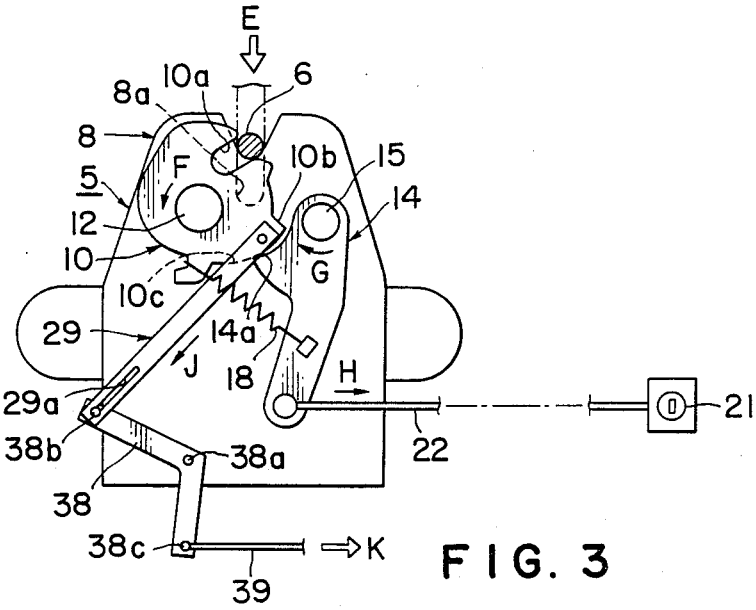
FIG. 3 is an illustration of a modified trunk lid locking device according to this invention, in which a link mechanism is substituted for the wire means of FIG. 2, the illustration showing the start of the locking operation.

When the trunk lid 2 is closed, the striker 6 secured to the inside of the rear edge of the trunk lid 2 moves down as viewed in FIG. 3 in the direction of arrow E to approach the locking mechanism 5 and is then engaged with a guide slot **8*a* formed in a latch body 8 of the locking mechanism 5. A claw 10 is mounted to be pivotable about a pin 12 secured to the latch body 8, and a detent lever 14 is also mounted to the latch body 8 to be pivotable about a pin 15 attached to the latch body 8. The claw 10 is normally urged to rotate in a counterclockwise direction as shown by arrow F by a spring not shown stretched between the claw 10** and the latch body 8, and the detent lever 14 is also normally urged to rotate in a clockwise direction as shown by arrow G by a spring 18 stretched between the detent lever 14 and the latch body 8. The claw 10 is provided with a guide slot 10*a* having an entrance opening located normally at a position to receive the striker 6. When the striker 6 is moved further down in the direction E, the striker 6 is inserted into the guide slot 10*a*, whereby the claw 10 is rotated in a clockwise direction opposite that of the arrow direction F against the urging force of the spring 18. During these successive operations, an engaging portion 14*a* provided on the detent lever 14 is maintained in sliding contact with an outer peripheral portion 10*c* extending to a stepped portion 10*b* of the claw 10, by the urging force of the spring 18.

The further downward movement of the striker 6 in the direction E makes further rotation of the claw 10 in the direction opposite that of the direction F until the engaging portion 14*a* of the detent lever 14 comes into engagement with the stepped portion 10*b* of the claw 10. At this moment, as shown in FIG. 4, the striker 6 is positioned deep in the guide slot 8*a* and engaged with the guide slot 10*a* at the deep bottom thereof, while the engaging portion 14*a* of the detent lever 14 and the stepped portion 10*b* of the claw 10 are firmly engaged by the urging forces of the spring members both acting on the lever 14 and the claw, thus performing the locking between the striker 6 of the trunk lid 2 and the latch body 8 on the trunk.

The distal end of the detent lever 14 is operatively connected to the key cylinder 21 through an opener link 22. When a key is inserted into the key cylinder 21 and rotated to open the closed trunk lid 2, the opener link 22 moves in the direction of arrow H against the spring urging force in the direction G acting on the detent lever 14. The movement of the opener link 22 in the direction of arrow H causes the detent lever 14 to disengage from the stepped portion 10*b* of the claw 10, whereby the claw 10 is rotated in the direction F by the force of the spring 18 to the position shown in FIG. 3 at which the striker 6 is ready for disengaging from the guide slot 8*a* of the latch 8.

Figure 4:
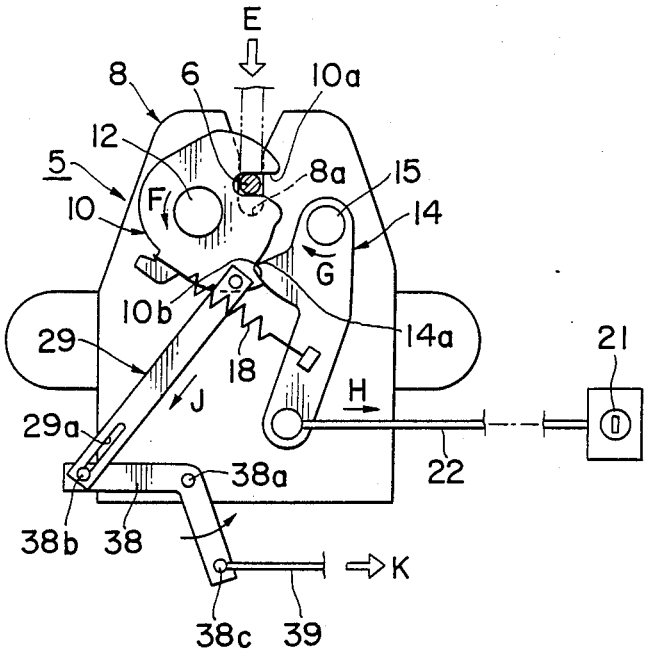
FIG. 4 is an illustration similar to FIG. 3 showing completion of the locking operation.

In the conventional technique, the trunk lid locking operation from the state shown in FIG. 3 to the state shown in FIG. 4 has been achieved by manually lowering the trunk lid 2. According to this invention, however, the trunk lid locking operation described above can be performed by utilizing an electric operating means as shown in FIG. 2.

Figure 2:
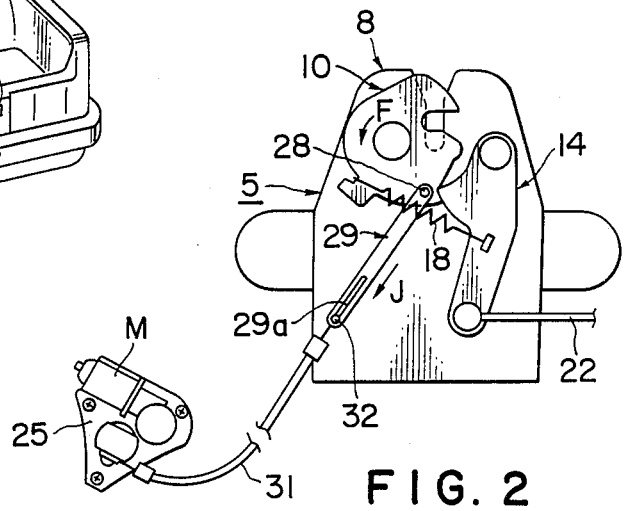
FIG. 2 is an illustration of a trunk lid locking device according to an embodiment of this invention, in which wire means is used for connection between a claw of a locking mechanism and an electrical driving device.
Figure 5:
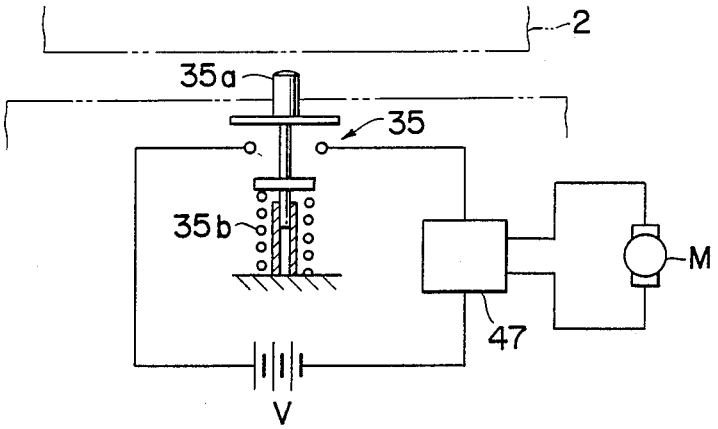
FIG. 5 is a diagrammatic view showing a circuit of a trunk lid sensor and a motor.
Figure 6:
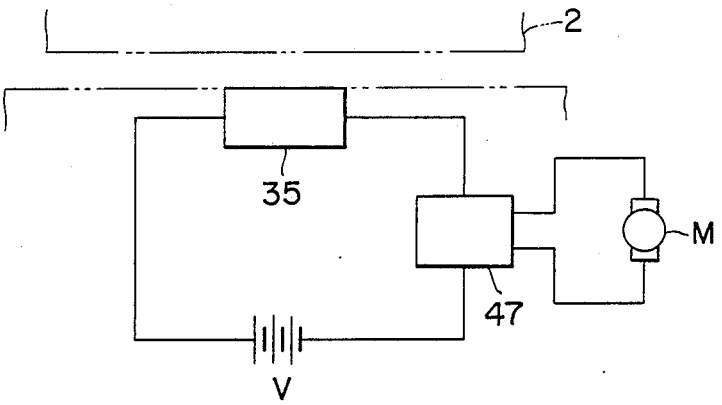
FIG. 6 is a view similar to FIG. 5 but showing a modification.

Referring to FIG. 2, an electric driving device 25 comprising an electric motor M and a control circuit means is mounted at a position near the locking mechanism 5. As shown in FIG. 5, the motor M of the electric driving device 25 is connected to the circuit of the switching unit or sensor 35 and an electric source V through a control circuit 47 having a timer. The sensor 35 has a normally open contact. When a key member 35*a* is depressed against the force of a spring 35*b* by the trunk lid 2 moved down to its closed position, the contact is closed and the motor M is energized for a predetermined time set by the timer of the control unit 47. The sensor 35 may be a noncontact sensor as shown in FIG. 6.

As shown in FIG. 2, a driving wire 31 extending from the motor M of the electric driving device 25 is connected to one end of an operating link 29 pivoted by a pin 28 at the other end thereof to the claw 10. The connection of the wire 31 and the link 29 is accomplished by slidably engaging a slider pin 32 of the wire 31 in an elongated lost-motion slot 29*a* formed in one end of the link 29.

When the trunk lid 2 is lowered to close the same, the sensor 35 detects the lowering of the trunk lid 2 to its closing position and energizes the motor M of the electric driving device 25 to draw the link 29 in the direction of arrow J through the wire 31 to thereby rotate the claw 10 in the direction opposite that of the direction of the arrow F. Therefore, the striker 6, which is at a position corresponding to the position shown in FIG. 3, is caused to move into the slots 8*a* and 10*a*, to ensure the locking between the striker 6 and the latch body 8. During this locking operation by means of the electric driving device 25, the slider pin 32 of the wire 31 is positioned at the outer end of the slot 29*a* of the link 29 as shown in FIG. 2. However, in the case where the lid 2 is manually lowered without using the motor M, the link 29 is moved in the direction of arrow J with respect to the slider pin 32 of the wire 31, which is not operated, so that the slider pin 32 of the wire 31 will finally be positioned at the inner end of the slot 29*a* whereby the trunk lid 2 can be closed independently of the electrical driving device 25.

In FIGS. 3 and 4, there is shown a modification in which a bell crank lever 38 and a connection rod 39 are substituted for the wire 31 of the embodiment shown in FIG. 2. The bell crank lever 38 is pivotally supported at 38*a* on the latch body 8 and has one end slidably engaged with the slot 29*a* of the link 29 through a slider pin 38*b* and the other end pivotally joined at 38*c* to one end of a connection rod 39. The other end of the connection rod 39 is connected to the electric driving device 25. The trunk lid locking operation is performed in substantially the same manner as described before, and in response to detection by the sensor 35 of the lowering of the trunk lid 2 to the closed position, the electric motor M is energized to draw the connection rod 39 in the direction of arrow K and hence to rotate the lever 38 and draw the link 29 in the direction of arrow J, thus locking the striker 6 on the trunk lid 2 to the latch body 8 of the locking mechanism 5, as shown in FIG. 4.

Figure 7:
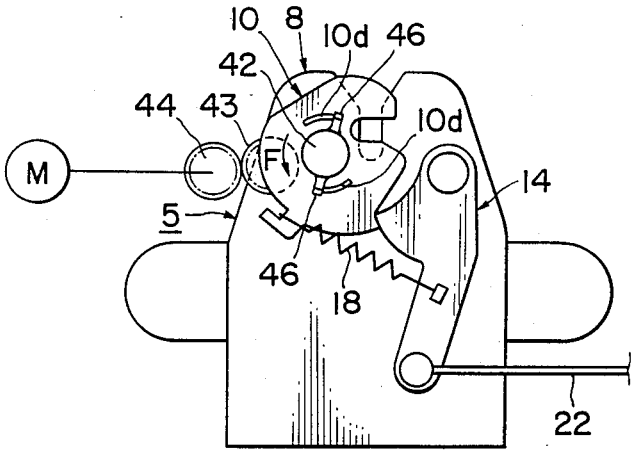
FIG. 7 is an illustration of a further modified trunk lid locking device according to this invention, in which a gear mechanism is substituted for the wire means shown in FIG. 2.

FIG. 7 shows a further modification according to this invention, in which a gear 42 is arranged coaxially with the center of rotation of the claw 10, i.e., the pivot pin 12 in the embodiments of FIGS. 2, 3 and 4, and the gear 42 is meshed with an intermediate gear 43 which is in turn meshed with a driving gear 44 coupled to the motor M of the electric driving device 25. The gear 42 is provided with radially projecting lugs 46 at two positions on the periphery of the gear 42 and the projecting lugs 46 have respective bent pieces slidably engaging arcuate slots 10*d* formed in the claw 10 concentrically with the center of rotation thereof.

According to this structure, when the trunk lid 2 is lowered to a position to close the trunk, the sensor 35 detects the lowering of the trunk lid 2 and energizes the motor M of the electric driving device 25. The driving gear 44 is rotated by the operation of the motor M and hence the gear 42 is rotated through the intermediate gear 43. In accordance with the rotation of the gear 42, the projecting lugs 46 are moved in the arcuate slots 10*d* formed in the claw 10 so as to abut against one ends of the slots 10*d* and to rotate the claw 10 in the direction opposite that of the direction of arrow F, thus causing the full engagement between the striker 6 and the guide slot 10*a* of the claw 10 and hence the locking of the trunk lid 2. The locking operation in the modification shown in FIG. 7 may also be performed by manually lowering the trunk lid 2.

The unlocking operation of the locking mechanism can be carried out by inserting a key into the key cylinder 21 and then rotating the same in all of the embodiment and its modifications described above. The operation of the key will cause the detent lever 14 to rotate counterclockwise, to thereby release the claw 10 from engagement with the detent lever 14.

The electrical driving device 25 is equipped with a control circuit to prevent accidental opening of the trunk lid while the motor vehicle is in motion. The device 25 may be provided with function as an electric lid opener by reverse rotation of the electric motor M in the device.

It is to be understood that this invention is not limited to the embodiments and its modification described above and other charges or modifications can be made within the scopes of the appended claims.

What is claimed is:

1. An automatic locking device for a trunk lid of a motor vehicle of the type in which a striker secured to an inner rear edge of the trunk lid is lockingly engaged with a locking mechanism secured to a rear edge of a trunk of the motor vehicle, said locking mechanism comprising a latch body fixed to the trunk and having a guide slot for receiving said striker therein, and a claw having a guide slot for receiving said striker therein and pivotally mounted to said latch body so as to be rotatable between a striker receiving position in which the guide slot of the claw is directed to receive the striker, and a locking position in which the guide slot of the claw constrains the striker near the inner end of the guide slot of the latch body, a trunk lid sensor for detecting lowering of the trunk lid to a closed position on the trunk, electric driving means including a motor which is operated in response to the detection of the trunk lid by said sensor, and motion transmitting means operatively interconnecting said driving means to said claw in such a manner that when the motor is operated, its motion is transmitted to the claw to cause the claw to rotate to its locking position to thereby lock the striker, wherein said motion transmitting means comprises:

a connection rod having one end operatively connected to said electric driving means, a link having one end pivotably secured to said claw, and a pivoted lever interconnecting said link and said connection rod, said lever having one end pivotably connected to the other end of said connection rod and the other end slidably connected to the other end of said link.

2. The automatic locking device according to claim 1 wherein the other end of said lever is provided with a slider pin and the other end of said link is provided with a lost motion slot with which said slider pin is in sliding engagement.

3. The automatic locking device according to claim 1 wherein said trunk lid sensor is an on-off switch inserted in the circuit of the motor.

4. The automatic locking device according to claim 1 wherein said trunk lid sensor is a non-contact sensor.

* * * * *